US008804465B2

(12) United States Patent
Fujisawa

(10) Patent No.: US 8,804,465 B2
(45) Date of Patent: Aug. 12, 2014

(54) ELECTRONIC TIMEPIECE WITH INTERNAL ANTENNA

(75) Inventor: Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/596,447

(22) Filed: Aug. 28, 2012

(65) Prior Publication Data

US 2013/0051181 A1 Feb. 28, 2013

(30) Foreign Application Priority Data

Aug. 30, 2011 (JP) ..... 2011-187270
May 17, 2012 (JP) ..... 2012-113357

(51) Int. Cl.
*G04B 37/00* (2006.01)

(52) U.S. Cl.
USPC ..... 368/14; 368/47

(58) Field of Classification Search
USPC ..... 368/14, 47, 280–281
See application file for complete search history.

(56) References Cited

U.S. PATENT DOCUMENTS

| | | | | |
|---|---|---|---|---|
| 5,646,634 | A * | 7/1997 | Bokhari et al. | 343/700 MS |
| 6,724,690 | B1 * | 4/2004 | Endo et al. | 368/10 |
| 6,992,952 | B2 * | 1/2006 | Endo et al. | 368/10 |
| 7,345,957 | B2 * | 3/2008 | Nirasawa | 368/47 |
| 2002/0071346 | A1 * | 6/2002 | Paratte et al. | 368/10 |
| 2003/0117903 | A1 * | 6/2003 | Nakajima et al. | 368/47 |
| 2009/0003141 | A1 * | 1/2009 | Ozawa | 368/294 |
| 2011/0102274 | A1 | 5/2011 | Fujisawa | |

FOREIGN PATENT DOCUMENTS

| | | |
|---|---|---|
| JP | 2003-050983 | 2/2003 |
| JP | 2003-152582 | 5/2003 |
| JP | 2011-097431 | 5/2011 |

* cited by examiner

*Primary Examiner* — Sean Kayes

(57) ABSTRACT

A small electronic timepiece with an internal antenna can maintain high GPS reception performance and affords greater freedom developing different models. The timepiece has a cylindrical outside case 80 of which at least part is made from a non-conductive material, a dial 11 that displays the time inside the case 80, a drive mechanism 30 that drives displaying the time on the dial 11 inside the case 80, and a C-shaped antenna 40 disposed around the drive mechanism 30 inside the case 80. A crystal 84 covers one of the two openings to the case 80, and a circuit board 25 with a GPS reception unit 26 for radio communication is disposed inside the case 80. The antenna 40 is disposed closer to the crystal 84 than the circuit board 25, and the GPS reception unit 26 is disposed on the back cover 85 side of the circuit board 25.

4 Claims, 7 Drawing Sheets

ELECTRONIC TIMEPIECE WITH INTERNAL ANTENNA

BACKGROUND

1. Technical Field

The present invention relates to an electronic timepiece with an internal antenna.

2. Related Art

Japanese Unexamined Patent Appl. Pub. JP-A-2003-050983 teaches an example of a wearable electronic device with a contactless data communication function. JP-A-2003-050983 more specifically describes a wristwatch that is worn on the user's wrist, and has an internal antenna as a contactless data communication unit. This technology simplifies reading and writing tickets by gate terminals installed at gates through which customers must pass when boarding a train or ski lift, for example.

Japanese Unexamined Patent Appl. Pub. JP-A-2011-097431 describes a more recent wearable electronic device such as a wristwatch that can receive GPS (Global Positioning System) signals and determine the current location. JP-A-2011-097431 more particularly relates to the GPS antenna used in an electronic device that is worn on the wrist. Even more specifically, a loop antenna having a dielectric body made from a non-conductive material is disposed inside a wristwatch, and a full-wavelength loop antenna relative to the wavelength of the wireless signals received can be housed inside the wristwatch by using the dielectric for wavelength shortening and reducing the antenna circumference.

With the technology described in JP-A-2011-097431, however, the antenna is covered by a dielectric and is disposed along the periphery of the dial. This increases the size of the bezel disposed around the outside of the antenna part, thus limiting timepiece design and inhibiting the development of different timepiece models.

SUMMARY

The present invention is directed to solving this problem and provides an electronic timepiece with an internal antenna that can maintain reception performance, reduce the limitations of the antenna on timepiece design, and provide greater freedom developing timepieces that can receive signals from positioning information satellites.

To achieve the foregoing object, an electronic timepiece with an internal antenna according to the invention has a cylindrical outside case of which at least part is made from a non-conductive material; a time display unit that displays time inside the outside case; a drive unit that drives the time display unit inside the outside case; and an antenna that receives signals from positioning information satellites, is disposed around the drive unit inside the outside case, and includes an annular dielectric base and an annular antenna element in contact with the dielectric base.

Because the antenna that functions as a loop antenna is disposed around the drive unit in the electronic timepiece with an internal antenna according to this aspect of the invention, the space inside the outside case can be used effectively, and a timepiece with a small diameter can be achieved. In addition, by using the wavelength shortening effect of the dielectric body, the size of the antenna can be reduced and a 1-wavelength loop antenna can be fit inside a compact timepiece with a small diameter.

The antenna element functions to convert electromagnetic waves to current. "Annular" as used herein includes circles and rectangles, as well as open loops with a gap (such as C-shaped configurations) and closed loops (such as O-shaped configurations). For example, if the antenna element is a C-shaped loop antenna, the pair of power supply nodes at the beginning and end of the loop antenna are on opposite sides of the gap in the C shape. As a result, the distance around the loop from the beginning to the end of the loop antenna is approximately 1-wavelength, and reception characteristics substantially equal to a configuration having two ½-wavelength dipole antennae in parallel with the supply nodes therebetween can be maintained.

The antenna could also have a plurality of antenna elements. For example, a C-shaped antenna element and an O-shaped antenna element could be combined. When two antenna elements are combined in the antenna, the two antenna elements are preferably electromagnetically coupled. If one antenna element (such as the O-shaped antenna element) is shaped to resonate with signals from positioning information satellites, the other antenna element (such as the C-shaped antenna element) can be shaped as desired, and antenna impedance can be easily matched to the circuit that is electrically connected to the antenna (the other antenna element).

As described above, an electronic timepiece with an internal antenna according to this embodiment of the invention can reduce the limitations of the antenna on timepiece design and improve the possibilities for model development while maintaining reception performance even when the timepiece is used to receive GPS signals, for example.

Materials other than metal, such as ceramics and plastics, can be used as the non-conductive material. The dial of a timepiece is included in the time display unit, and the time may be displayed on the dial using analog hands or digitally with an LCD panel, for example. The hands may include an hour hand, minute hand, and second hand. "Contact with the dielectric" includes, in addition to contacting the surface of the dielectric, embedding the antenna element inside the dielectric body by insert molding, for example.

An electronic timepiece with an internal antenna according to another aspect of the invention preferably also has a crystal covering one of the two openings in the outside case; a metal back cover covering the other of the two openings on the opposite side of the time display unit as the display side; and a circuit board that is housed inside the outside case and includes a radio communication circuit for radio communication; wherein the antenna is disposed on the crystal side of the circuit board, and the radio communication circuit is disposed on the back cover side of the circuit board.

The circuit board can therefore be disposed between the antenna and the GPS module or other radio communication circuit, and the adverse effect of in-band noise (noise in the frequency band of the reception signal), such as the clock signal generated by the radio communication circuit, on the antenna can be reduced. As a result, a drop in antenna sensitivity can be reduced.

Further preferably in an electronic timepiece with an internal antenna according to another aspect of the invention, the antenna includes an insertion unit for inserting an operator of the electronic timepiece from the outside of the antenna to the drive unit.

This enables inserting an operator such as the winding stem of the crown or an operating button through the insertion unit from outside of the antenna to the drive unit inside the antenna, avoiding interference between the antenna and the operator, and increasing freedom in the placement of the antenna.

The insertion unit could be a through-hole that passes radially through the side of the antenna 40, or a groove or notch that accommodates the operator and passes radially through the antenna.

Further preferably in an electronic timepiece with an internal antenna according to another aspect of the invention, the antenna element is disposed in contact with the crystal side of the dielectric base.

In this configuration, radiation perpendicular to the timepiece face is increased by reflection by the metal back cover, and extremely high reception performance can be achieved. By disposing the antenna on the crystal side of the dielectric, sufficient distance from the metal back cover can be assured, and reception sensitivity to signals from the crystal side can be improved.

Further preferably, an electronic timepiece with an internal antenna according to another aspect of the invention also has a solar panel for photovoltaic generation; and part or all of the crystal side of the antenna is disposed closer to the crystal than is the solar panel.

An aluminum electrode several microns thick is generally disposed to the bottom surface of the solar panel, and reception performance drops as a result. However, by disposing part or all of the crystal side of the antenna above and closer to the crystal than the solar panel, reception performance can be maintained.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the size and scale of parts shown in the figures differ from the actual size and scale for convenience. Furthermore, the following examples are specific preferred embodiments of the invention and describe technically desirable limitations, and the scope of the invention is not limited thereby unless such limitation is specifically stated below.

Embodiment 1

Figure 1:
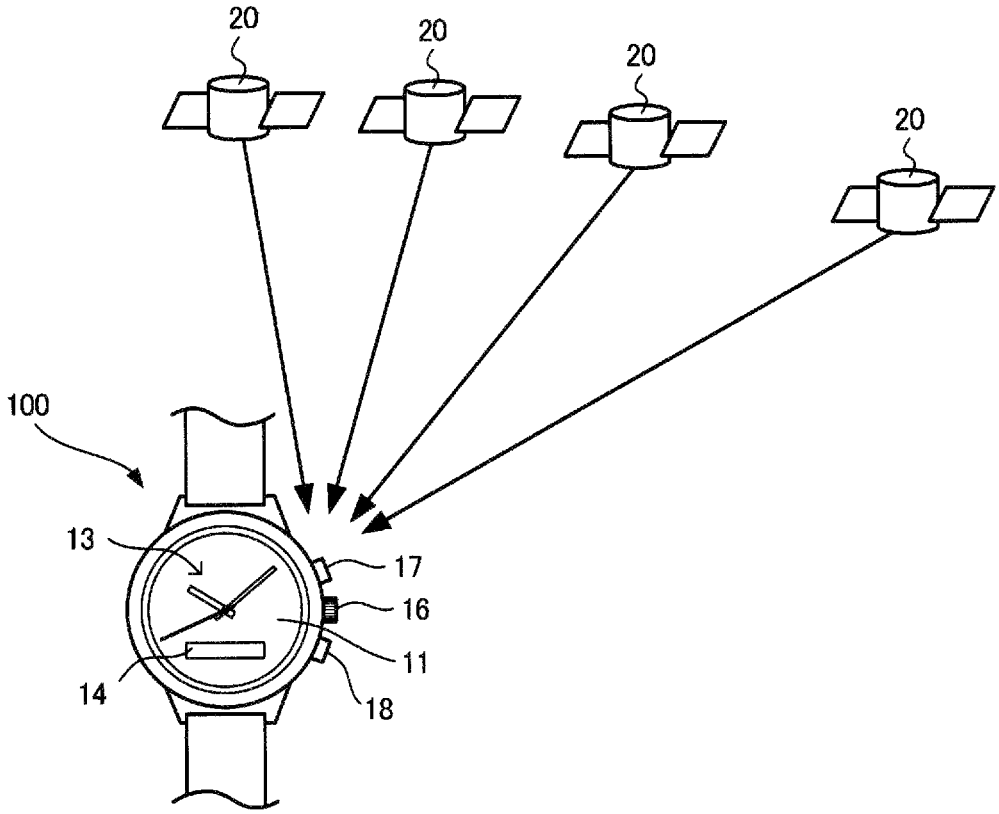
FIG. 1 shows the general configuration of a GPS system including an electronic timepiece with internal antenna 100 (electronic timepiece 100) according to a first embodiment of the invention.

FIG. 1 shows the general configuration of a GPS system including an electronic timepiece with internal antenna 100 (electronic timepiece 100) according to a first embodiment of the invention. This electronic timepiece 100 is a wristwatch that receives signals (radio signals) from GPS satellites 20 and adjusts the internal time based thereon, and displays the time on the surface (side) (referred to below as the "face") on the opposite side as the surface (referred to below as the "back") that contacts the wrist.

A GPS satellite 20 is a positioning information satellite that orbits the Earth on a fixed orbit, and transmits navigation messages superimposed on a 1.57542 GHz RF signal (L1 signal). The 1.57542 GHz signal carrying a superimposed navigation message is referred to herein as simply a "satellite signal." These satellite signals are right-handed circularly polarized waves.

Note that a GPS satellite 20 is used below as an example of a positioning information satellite in the GPS system, but the positioning information satellite of the invention is not limited to GPS satellites and the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

There are currently approximately 31 GPS satellites 20 in orbit (only 4 of the 31 satellites are shown in FIG. 1). To determine from which GPS satellite 20 a satellite signal was sent, each GPS satellite 20 superimposes a unique 1023 chip (1 ms period) pattern called a C/A code (Coarse/Acquisition code) on the satellite signal. Each chip in the C/A code is either +1 or −1, and looks like a random pattern. The C/A code superimposed on the satellite signal can therefore be detected by correlating the satellite signal with each C/A code pattern.

Each GPS satellite 20 carries an atomic clock, and the highly precise time information ("GPS time information" below) kept by the atomic clock is included in each satellite signal. The slight time difference of the atomic clock onboard each GPS satellite 20 is measured by the ground control segment, and a time correction parameter for correcting this time difference is also included in the satellite signal. The electronic timepiece 100 receives a satellite signal transmitted from one GPS satellite 20, and corrects the internal time to the correct current time based on the GPS time information and time correction parameter contained in the received satellite signals.

Orbit information describing the position of the GPS satellite 20 on its orbit is also included in the satellite signal. The electronic timepiece 100 can calculate its position using the GPS time information and orbit information. This positioning calculation assumes that there is a certain amount of error in the internal time of the electronic timepiece 100. More specifically, in addition to the x, y, z parameters for determining the three-dimensional position of the electronic timepiece 100, this time difference is also an unknown. Therefore, the electronic timepiece 100 generally receives satellite signals transmitted from four or more GPS satellites, and calculates the current position using the GPS time information and orbit information contained in the received signals.

Figure 2:
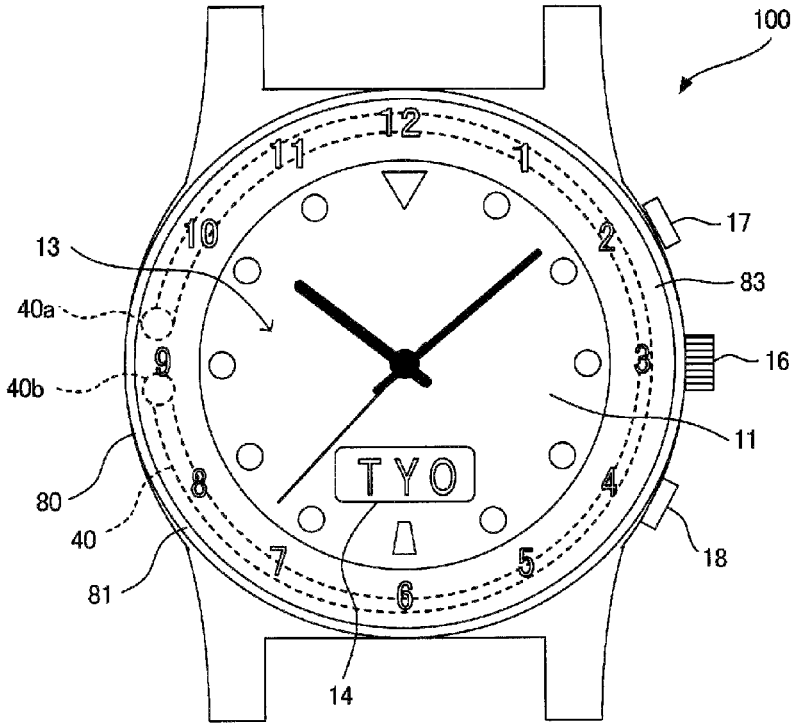
FIG. 2 is a plan view of the electronic timepiece 100.

FIG. 2 is a plan view of the electronic timepiece 100. As shown in FIG. 2, the electronic timepiece 100 has a cylindrical outside case 80 made of a non-conductive material such as ceramic or plastic. An annular bezel 81 made of a non-conductive material such as ceramic or plastic is fit around the outside edge on the face side of the case 80. A round dial 11 used as a time display unit is held on the inside circumference side of the bezel 81 by an annular dial ring 83 made of plastic.

Hands 13 (13*a* to 13*c*) for indicating the time or date, for example, are disposed above the dial 11. An LCD panel 14 is disposed on the back side of the dial 11. The opening on the face side of the case 80 is covered by a crystal 84 with the bezel 81 therebetween. The dial 11, hands 13 (13*a* to 13*c*), and LCD panel 14 on the inside can be seen through the crystal 84. Note that the letters TYO shown in the LCD panel 14 in FIG. 2 indicate Tokyo, and tell the user that the time displayed by the world time function is Japan time.

The dial ring 83 is an annular plastic member that contacts the inside circumference of the bezel 81. An antenna 40 with an antenna element that is C-shaped, that is, a loop with part missing, is held below the dial ring 83.

The antenna 40 is constructed in a ring having a loop antenna with a part of the loop removed disposed around the outside of the dial 11 used as the time display unit. The antenna 40 according to this embodiment of the invention is disposed inside the case 80 around the outside of the drive mechanism 30. More specifically, the drive mechanism 30 is held inside the main plate 38, and the annular antenna 40 is fit around the outside of the main plate 38. The two power supply nodes 40*a* and 40*b* of the antenna 40 are disposed to the outside circumference of the main plate 38. The supply nodes 40*a* and 40*b* are at the beginning and end of the antenna 40, and are electrodes for supplying power to the antenna 40.

By manipulating the crown 16 and buttons 17, 18 shown in FIG. 1 and FIG. 2, the electronic timepiece 100 can be set to a mode (time information acquisition mode) that receives satellite signals from at least one GPS satellite 20 and adjusts the internal time information, and a mode (positioning information acquisition mode) that receives satellite signals from a plurality of GPS satellites 20, calculates the position, and adjusts the time difference of the internal time information. The electronic timepiece 100 can also regularly (automatically) execute the time information acquisition mode and the positioning information acquisition mode.

Figure 3:
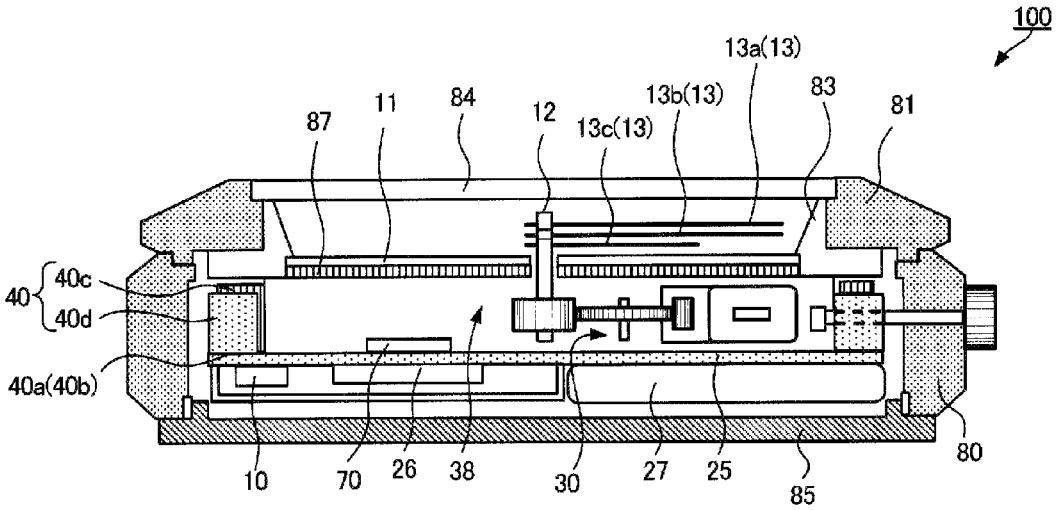
FIG. 3 is a partial section view of the electronic timepiece 100.
Figure 4:
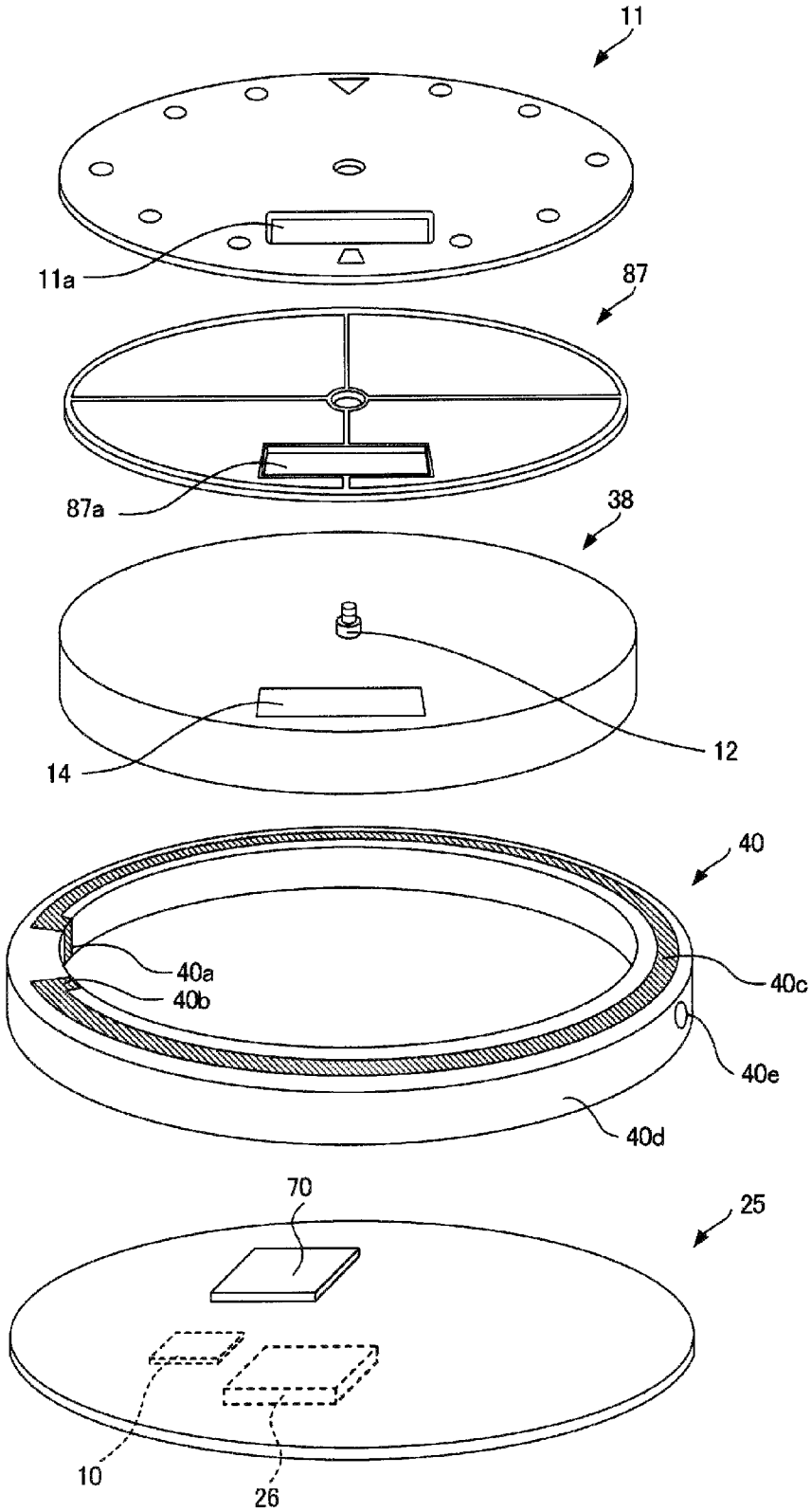
FIG. 4 is an exploded perspective view of part of the electronic timepiece 100.

FIG. 3 is a section view showing part of the internal configuration of the electronic timepiece 100, and FIG. 4 is an exploded oblique view showing part of the electronic timepiece 100.

As shown in FIG. 3 and FIG. 4, the annular bezel 81 made of ceramic is fit to the face side of the ring-shaped case 80, which is also made of ceramic. The annular dial ring 83 made of plastic is attached to the inside circumference of the bezel 81. Of the two openings in the case 80, the opening on the face side is closed by the crystal 84 with the annular bezel 81 therebetween, and the opening on the back side is covered by a back cover 85 made of metal. The metal back cover 85 and the case 80 fit together with packing therebetween.

The electronic timepiece 100 also has a lithium ion or other type of storage battery 27 inside the case 80. The storage battery 27 is charged by power generated by a solar panel 87 described below, that is, is charged by solar power.

Inside the case 80 the electronic timepiece 100 also has a light-transparent dial 11, a center shaft 12 that passes through the dial 11, plural hands 13 (including a second hand 13*a*, minute hand 13*b*, and hour hand 13*c*) that indicate the current time and rotate on the center shaft 12, and a drive mechanism 30 that causes the center shaft 12 to turn and drives the plural hands 13. The center shaft 12 extends between the face and back on the center axis of the case 80.

The dial 11 is a disc-shaped member used as a time display unit on which the time is displayed inside the case 80, and is made of plastic or other optically transparent material. The dial 11 is disposed on the inside of the dial ring 83 with the hands 13 (13*a* to 13*c*) between the dial 11 and the crystal 84. A hole through which the center shaft 12 passes is formed in the center of the dial 11, and a window for viewing the LCD panel 14 is also formed in the dial 11.

The drive mechanism 30 is disposed to the main plate 38, and includes a drive train including a stepper motor and wheel train. The stepper motor drives the plural hands 13 by turning the hands 13 through the wheel train. More specifically, the hour hand 13*c* turns one revolution in 12 hours, the minute hand 13*b* turns one revolution in 60 minutes, and the second hand 13*a* turns one revolution in 60 seconds. The main plate 38 to which the drive mechanism 30 is affixed is disposed with the dial 11 between the main plate 38 and the hands 13.

The electronic timepiece 100 also has a solar panel 87 for photovoltaic generation inside the case 80. The solar panel 87 is a disc with a plurality of solar cells (photovoltaic devices) that convert light energy to electrical energy (power) connected in series. The solar panel 87 is disposed between the dial 11 and the drive mechanism 30, and extends transversely to the center shaft 12. The solar panel 87 extends in this transverse direction inside the dial ring 83. A hole through which the center shaft 12 passes is formed in the center part of the solar panel 87, and a window for viewing the LCD panel 14 is also formed.

Inside the case 80 the electronic timepiece 100 also has a circuit board 25, a balun 10 mounted on the circuit board 25, a GPS receiver (wireless reception unit) 26, and a control unit 70. The balun 10 is a balanced-unbalanced conversion device, and converts balanced signals from the antenna 40, which operates with a balanced power supply, to unbalanced signals that can be handled by the GPS reception unit 26.

The electronic timepiece 100 has an antenna 40 with an antenna element in the shape of a loop with part missing. The antenna 40 is made by forming a metal antenna conductor 40*c* on a ring-shaped dielectric base 40*d* by means of plating or printing silver paste. The antenna conductor 40*c* functions as an antenna element that converts electromagnetic waves to current. Note that the antenna conductor 40*c* is formed on the crystal 84 side of the dielectric base 40*d*, is disposed closer to the crystal 84 than the circuit board 25, and is covered from above by the dial ring 83 and bezel 81. The dielectric base can be made by mixing a dielectric material that can be used at high frequencies, such as titanium oxide, with a plastic resin, which combined with the wavelength shortening effect of the dielectric enables reducing the size of the antenna.

For example, because GPS signals are transmitted at 1.575 GHz and have a wavelength of 19 cm, a normal antenna cannot be fit in the bezel of a wristwatch, and wavelength shortening is therefore required. Because in this embodiment the wavelength shortening effect of the dielectric is $(\Sigma_r)^{1/2}$, a dielectric base 40*d* with $\Sigma_r$=5–10 is used. This enables reducing the size of the antenna and fitting a 1-wavelength loop antenna for receiving GPS signals in the wristwatch.

The antenna 40 is energized through the supply nodes 40*a* and 40*b* at opposite ends of the antenna conductor 40*c*, that is, at positions beside the opening in the C shape. These supply nodes 40*a* and 40*b* are connected to antenna connection terminals not shown located below the antenna. The antenna connection terminals are disposed on the circuit board 25 and contact the supply nodes 40*a* and 40*b* that wrap around to the bottom of the antenna 40, thereby connecting the circuit board 25 and antenna 40.

Power supply to the antenna 40 in this embodiment is balanced from the balun 10 through the two supply nodes 40*a* and 40*b*. More specifically, the antenna 40 has positive and negative supply nodes 40*a* and 40*b* at opposite ends of the antenna conductor 40*c*, and these two supply nodes 40*a* and 40*b* are connected to the antenna connection terminals. Balanced power is supplied through these antenna connection terminals, and the GPS reception unit 26 receives radio signals through the antenna 40. Note that because the antenna 40 is a 1-wavelength loop antenna, it is self-balancing to the power supply, and power can be supplied directly thereto without going through the balun 10.

A through-hole 40*e* is formed in the side of the antenna 40 from the outside of the antenna 40 to the drive mechanism 30 inside the antenna 40. The through-hole 40*e* is a hole that enables passing an operator such as the stem of the crown or an operating button through the through-hole 40*e* from the outside of the antenna 40 to the drive mechanism 30 inside the antenna 40, and is disposed to a position corresponding to the operator. FIG. 4 shows the through-hole 40*e* as a hole passing radially through the dielectric base 40*d* from the side, but if the operator can pass therethrough, the through-hole 40*e* could be a groove or a notch passing radially through the antenna 40.

Figure 5:
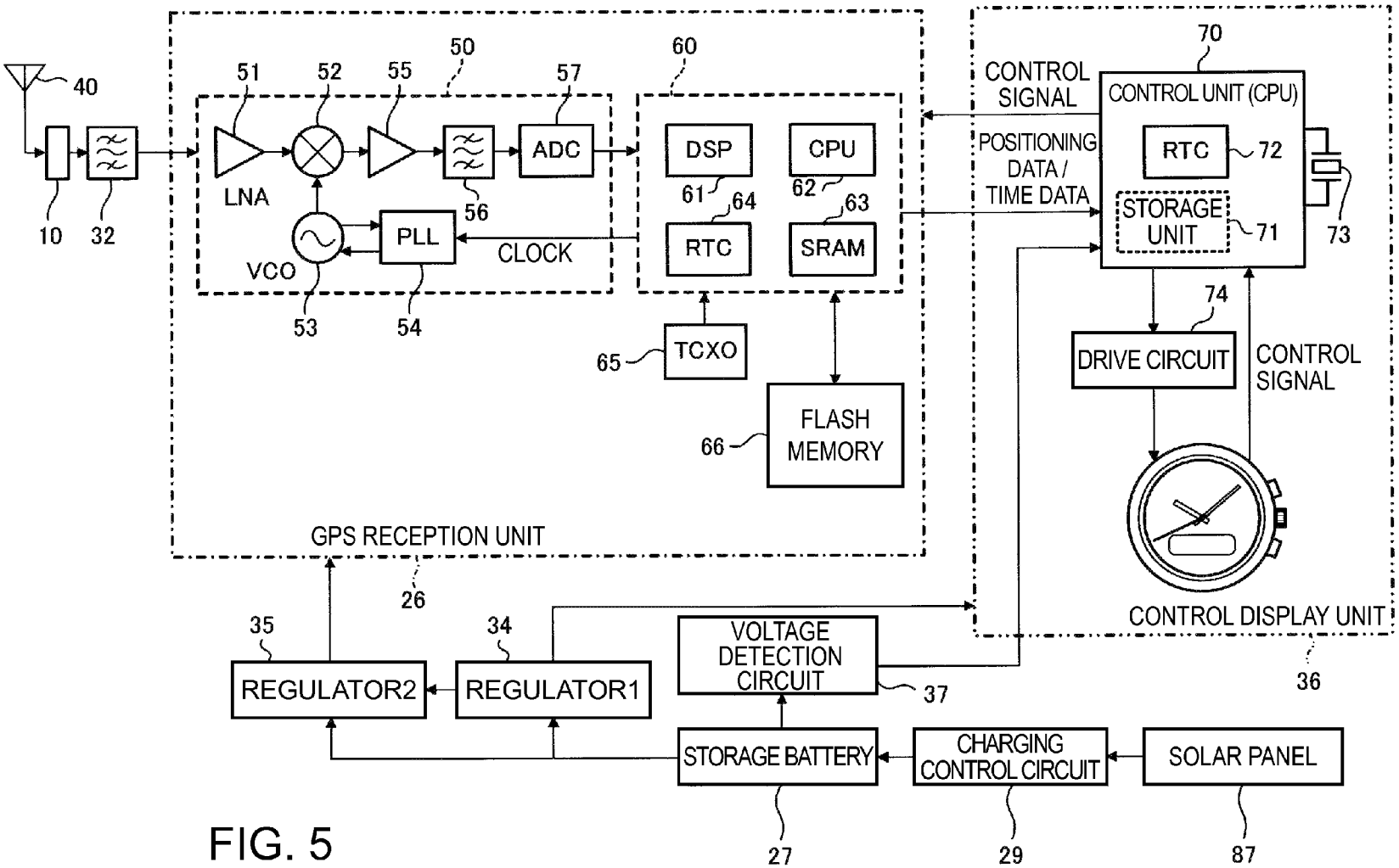
FIG. 5 is a block diagram showing the circuit configuration of the electronic timepiece 100.

FIG. 5 is a block diagram showing the circuit configuration of the electronic timepiece 100.

As shown in FIG. 5, the electronic timepiece 100 is configured with a GPS reception unit 26 and a control display unit 36. The GPS reception unit 26 executes processes including receiving satellite signals, locking onto GPS satellites 20, generating positioning information, and generating time adjustment information. The control display unit 36 executes processes including storing the internal time information, and correcting the internal time information.

The solar panel 87 charges the storage battery 27 through the charging control circuit 29. The electronic timepiece 100 also includes regulators 34 and 35. The storage battery 27 supplies drive power through regulator 34 to the control display unit 36, and through regulator 35 to the GPS reception unit 26. The electronic timepiece 100 also has a voltage detection circuit 37 that detects the storage battery 27 voltage.

Alternatively, regulator 35 could be split into a regulator 35-1 (not shown in the figure) that supplies drive power to the RF unit 50 (described below), and a regulator 35-2 (not shown in the figure) that supplies drive power to the baseband unit 60 (described below). In this case, regulator 35-1 could be disposed in the RF unit 50.

The electronic timepiece 100 also includes the antenna 40, balun 10, and a SAW (surface acoustic wave) filter 32. As described in FIG. 1, the antenna 40 receives satellite signals from a plurality of GPS satellites 20. However, because the antenna 40 also receives some extraneous signals other than the desired satellite signals, the SAW filter 32 executes a process that extracts the satellite signals from the signals received by the antenna 40. More specifically, the SAW filter 32 is configured as a bandpass filter that passes signals in the 1.5 GHz waveband.

The GPS reception unit 26 includes the RF (radio frequency) unit 50 and baseband unit 60. As described below, the GPS reception unit 26 executes a process that acquires satellite information including orbit information and GPS time information contained in the navigation messages from the satellite signals in the 1.5 GHz band extracted by the SAW filter 32.

The RF unit 50 is composed of a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

Satellite signals extracted by the SAW filter 32 are amplified by the LNA 51. The satellite signals amplified by the LNA 51 are mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the clock signal output from the VCO 53 to the reference clock signal. As a result, the VCO 53 can output a stable clock signal with the frequency precision of the reference clock signal. Note that several megahertz, for example, can be selected as the intermediate frequency.

The mixed signal output from the mixer 52 is amplified by the IF amplifier 55. This mixing by the mixer 52 results in both an IF signal and a high frequency signal of several GHz. As a result, the IF amplifier 55 amplifies both the IF signal and the high frequency signal of several GHz. The IF filter 56 passes the IF signal and removes the high frequency signal of several GHz (more accurately, attenuates the signal to a specific level or less). The IF signal passed by the IF filter 56 is converted to a digital signal by the A/D converter 57.

The baseband unit 60 includes a DSP (digital signal processor) 61, CPU (central processing unit) 62, SRAM (static random access memory) 63, RTC (real-time clock) 64. A TCXO (temperature compensated crystal oscillator) 65 and flash memory 66 are also connected to the baseband unit 60.

The TCXO 65 generates a reference clock signal of a substantially constant frequency regardless of temperature. Time difference information, for example, is stored in flash memory 66. The time difference information is information with a defined time difference (such as correction to UTC related to known coordinates (such as latitude and longitude)).

The baseband unit 60 executes a process that demodulates the baseband signal from the digital signal (IF signal) converted by the A/D converter 57 of the RF unit 50 when set to the time information acquisition mode or the positioning information acquisition mode.

In addition, when set to the time information acquisition mode or the positioning information acquisition mode, the baseband unit 60 executes a process in the satellite search step described below that generates a local code of the same pattern as each C/A code, and correlates the local codes to the C/A code contained in the baseband signal. The baseband unit 60 adjusts the timing when the local code is generated to find the peak correlation to each local code, and when the correlation equals or exceeds a threshold value, determines that the local code synchronized with the GPS satellite 20 (that is, locked onto a GPS satellite 20). Note that the GPS system uses a CDMA (Code Division Multiple Access) method where by all GPS satellites 20 transmit satellite signals on the same frequency using different C/A codes. The GPS satellites 20 that can be locked onto can therefore be found by identifying the C/A code contained in the received satellite signal.

When in the time information acquisition mode or the positioning information acquisition mode, the baseband unit 60 also executes a process that mixes the baseband signal with the local code of the same pattern as the C/A code of the GPS satellite 20 in order to acquire the satellite information from the GPS satellite 20 that was locked. The navigation message containing the satellite information from the GPS satellite 20 that was locked onto is demodulated in the mixed signal. The baseband unit 60 then executes a process to detect the TLM word (preamble data) of each subframe in the navigation message, and acquire (such as store in SRAM 63) satellite information such as the orbit information and GPS time information contained in each subframe. The GPS time information as used here is the week number (WN) and Z count, but the Z count data alone could be acquired if the week number was previously acquired.

The baseband unit 60 then generates the time adjustment information required to correct the internal time information based on the satellite information.

In the time information acquisition mode, the baseband unit 60 more specifically calculates the time based on the GPS time information, and outputs time adjustment information. The time adjustment information in the time information acquisition mode could be, for example, the GPS time information itself, or information about the time difference between the GPS time information and the internal time information.

However, in the positioning information acquisition mode, the baseband unit 60 more specifically calculates the position based on the GPS time information and orbit information, and acquires position information (more specifically the latitude and longitude of the place where the electronic timepiece 100 was located when the signals were received). The baseband unit 60 also references the time difference information stored in flash memory 66, and acquires time difference data related to the coordinates (such as the latitude and longitude) of the electronic timepiece 100 identified by the position information. The baseband unit 60 thus generates satellite time data (GPS time) and time difference data as the time adjustment information. The time adjustment information in the positioning information acquisition mode may be the GPS time information and time difference data as described above, but instead of the GPS time may alternatively be the time difference between GPS time and the internal time.

Note that the baseband unit 60 may generate the time adjustment information based on satellite information from one GPS satellite 20, or it could generate the time adjustment information based on satellite information from plural GPS satellites 20.

Operation of the baseband unit 60 is synchronized to the reference clock signal output by the TCXO 65. The RTC 64 generates timing signals for processing the satellite signals. This RTC 64 counts up at the reference clock signal output from the TCXO 65.

The RTC 64 provided in the baseband unit 60 operates only when receiving a satellite signal from a GPS satellite 20, and holds the GPS time information.

The control display unit 36 includes a control unit 70, drive circuit 74, and crystal oscillator 73.

The control unit 70 has a storage unit 71 and RTC (real-time clock) 72, and controls various operations. The control unit 70 can be rendered by a CPU, for example.

The control unit 70 sends control signals to the GPS reception unit 26, and controls the reception operation of the GPS reception unit 26. Based on output from the voltage detection circuit 37, the control unit 70 also controls operation of regulator 34 and regulator 35. The control unit 70 also controls driving all of the hands through the drive circuit 74.

Internal time information is stored in the storage unit 71. The RTC 72 operates continuously, keeps the internal time for displaying the time, and generates internal time information. The internal time information is information about the time kept internally by the electronic timepiece 100, and is updated with a reference clock signal generated by the crystal oscillator 73. Updating the internal time information and moving the hands can therefore continue even when power supply to the GPS reception unit 26 stops.

When the time information acquisition mode is set, the control unit 70 controls operation of the GPS reception unit 26, and corrects and stores the internal time information in the storage unit 71 based on the GPS time information. More specifically, the internal time information is adjusted to UTC (Coordinated Universal Time), which is obtained by adding the UTC offset to the acquired GPS time. When set to the positioning information acquisition mode, the control unit 70 controls operation of the GPS reception unit 26, and based on the satellite time information (GPS time) and time difference data, adjusts and stores the internal time information in the storage unit 71.

As described above, the antenna 40 of this electronic timepiece 100 is a C-shaped loop antenna, and has a pair of power supply nodes 40*a* and 40*b* as the start and end points of the loop antenna disposed with the gap in the C-shape therebetween. As a result, the distance around the loop between the ends of the antenna 40, that is, the distance from the beginning to the end of the loop antenna, is approximately 1 wavelength as a result of wavelength shortening by the dielectric base 40*d*, and reception characteristics substantially equal to a configuration having two ½-wavelength dipole antennae in parallel with the supply nodes 40*a* and 40*b* therebetween can be maintained.

The space inside the outside case can also be used effectively, and a small timepiece with a small diameter can be achieved, by disposing the antenna around the drive mechanism 30. More specifically, the electronic timepiece 100 can use the space inside the antenna 40 because the antenna 40 is a loop antenna with a donut shape (O shape) when seen in plan view. More specifically, the drive mechanism 30 and other parts can be disposed in the space inside the antenna 40. The electronic timepiece 100 can therefore be made smaller than when the antenna 40 is not a loop antenna (such as when a patch antenna is used).

By using a loop antenna as the antenna 40, this embodiment of the invention has the advantage of reducing the limitations of the antenna 40 on electronic timepiece 100 design and improving freedom of design in developing new models of electronic timepieces 100 compared with configurations using a patch antenna.

Figure 6:
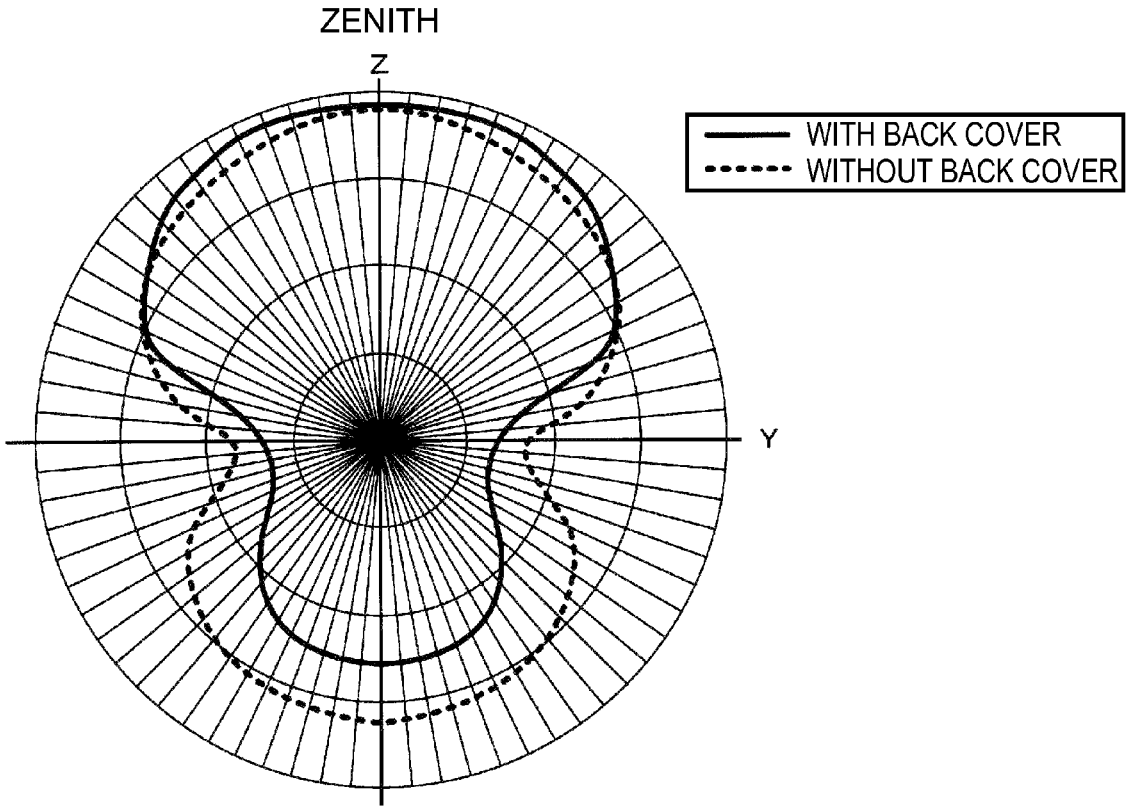
FIG. 6 shows the radiation pattern on the Y-Z plane of the antenna 40 of the electronic timepiece 100.

FIG. 6 shows the radiation pattern of the antenna 40, and shows the radiation pattern on the Y-Z plane when the center of the antenna 40 is at the origin, the horizontal plane through the face of the timepiece is the X-Y plane, and the normal to the timepiece face is the Z axis.

FIG. 6 compares the antenna radiation patterns when the metal back cover is and is not present. As shown in FIG. 6, radiation in the direction perpendicular to the dial (Z-axis direction) increases on the Y-Z plane due to reflection when the metal back cover is in place.

Antenna performance drops when the case is metal if the antenna is too close to the case, but this problem is avoided in this embodiment because the case 80 is non-conductive. The back cover 85 is shielded by the main plate 38 and drive mechanism 30, and is a suitable distance from the antenna 40. The back cover 85 therefore functions as a reflector that increases antenna performance perpendicularly to the dial (z-axis).

Satellite signals from GPS satellites 20 are different from signals from mobile communication signals that come from all directions, and are received from directly above. In order for the electronic timepiece 100 to have good antenna performance, the antenna must have a good radiation pattern in the direction of the zenith. When the electronic timepiece 100 is worn on the wrist and the user is looking at the dial, the dial (Z-axis) is generally facing the zenith.

Desirable antenna performance can therefore be achieved when an electronic timepiece 100 having a back cover 85 with good antenna characteristics perpendicularly to the dial is worn on the wrist and the dial is facing the zenith.

The size of the antenna can also be reduced in the electronic timepiece 100 by using the wavelength shortening effect of the dielectric base 40*d*. More specifically, because the wavelength shortening effect of the dielectric is $(\Sigma_r)^{1/2}$, a dielectric base 40*d* with $\Sigma_r$=5–10 is used. This enables reducing the size of the antenna and fitting a 1-wavelength loop antenna for receiving GPS signals in the wristwatch. Because a ground plate is not required, the antenna 40 can also be desirably used in compact devices that are unable to accommodate a large ground plate. The antenna 40 in this embodiment is made by forming a metal antenna conductor 40*c* on a ring-shaped dielectric base 40*d* by means of plating or printing silver paste. Forming the antenna conductor 40*c* on the surface enables easier manufacture and tuning.

Because the antenna 40 receives balanced power through the supply nodes 40*a* and 40*b*, the supply nodes 40*a* and 40*b* can create a balanced antenna pattern, and reception performance can be improved. In addition, because the antenna 40 is disposed closer to the crystal 84 than the circuit board 25, the circuit board 25 can be disposed between the antenna 40 and the GPS reception unit 26 or other GPS module. The adverse effect of in-band noise (noise in the frequency band of the reception signal), such as the clock signal generated by the GPS reception unit 26, on the antenna 40 can therefore be reduced. As a result, a drop in antenna 40 sensitivity can be reduced.

A through-hole 40*e* is formed in the antenna 40 from the outside of the antenna 40 to the drive mechanism 30 inside the antenna 40. An operator such as the stem of the crown or an operating button can therefore pass through the through-hole 40*e* from the outside of the antenna 40 to the drive mechanism 30 inside the antenna 40. As a result, interference between the antenna 40 and the operator can be avoided, and there is greater freedom in the placement of the antenna 40.

As described above, an electronic timepiece with an internal antenna according to this embodiment of the invention can reduce the limitations of the antenna on timepiece design and improve the possibilities for model development while maintaining reception performance even when the timepiece is used to receive GPS signals, for example.

Embodiment 2

Figure 7:
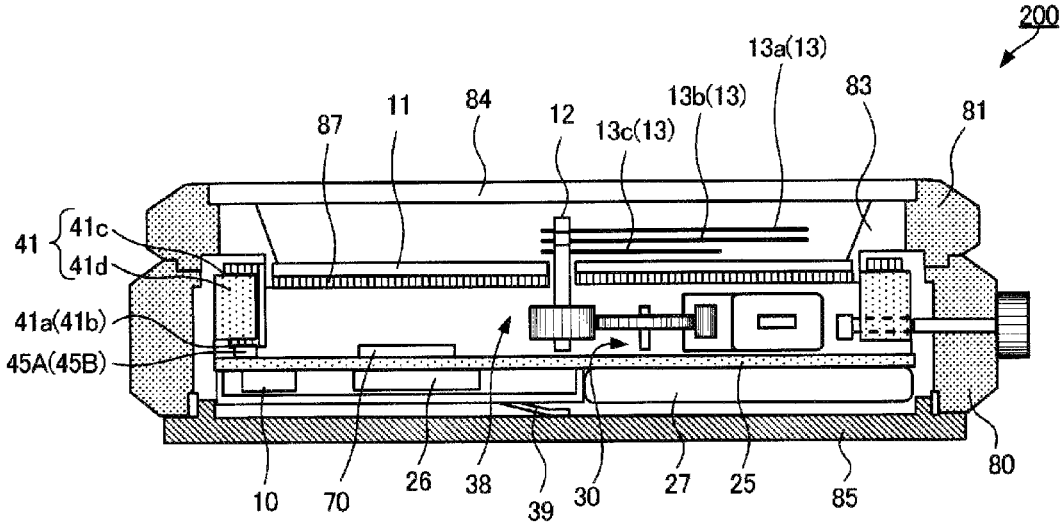
FIG. 7 is a partial section view of an electronic timepiece with internal antenna 200 (electronic timepiece 200) according to a second embodiment of the invention.

FIG. 7 is a partial section view of an electronic timepiece with internal antenna 200 (electronic timepiece 200) according to a second embodiment of the invention. This electronic timepiece 200 differs from the electronic timepiece 100 in using a different antenna 41 than the antenna 40 described above. This antenna 41 differs from the above antenna 40 in that the crystal 84 side surface of the antenna 41 is closer to the crystal 84 than is the surface of the solar panel 87.

The antenna 41 in this embodiment as shown in FIG. 7 is specifically disposed around the drive mechanism 30, and part or all of the crystal 84 side of the antenna 41 is closer to the crystal 84 than is the solar panel 87. More specifically, the electronic timepiece 200 has an antenna 41 with an antenna conductor 41*c* in the shape of a loop with part missing. The antenna 41 is made by forming a metal antenna conductor on a ring-shaped dielectric base by means of plating or printing silver paste. Note that the antenna conductor is formed on the crystal 84 side of the dielectric base, is disposed closer to the crystal 84 than the circuit board 25, and is disposed closer to the crystal 84 than the solar panel 87.

The antenna 41 is energized through the supply nodes 41*a* and 41*b* at opposite ends of the antenna conductor 41*c*, that is, at positions beside the opening in the C shape. These supply nodes 41*a* and 41*b* are connected to antenna connection pins 45A and 45B located below the antenna. The antenna connection pins 45A and 45B are pin-like connectors with an internal spring. The antenna connection pins 45A and 45B protrude from the circuit board 25, and connect the circuit board 25 and the internal antenna 41.

Power supply to the antenna 41 in this embodiment is balanced from the balun 10 through the two supply nodes 41*a* and 41*b*. More specifically, the antenna 41 has positive and negative supply nodes 41*a* and 41*b* at opposite ends of the antenna 41, and these two supply nodes 41*a* and 41*b* are connected to the antenna connection pins 45A and 45B. Balanced power is supplied through these antenna connection pins 45A and 45B, and the GPS reception unit 26 receives radio signals through the antenna 41. Note that because the antenna 41 is a 1-wavelength loop antenna, it is self-balancing to the power supply, and power can be supplied directly thereto without going through the balun 10.

As will be understood from the foregoing description, the electronic timepiece 200 according to this embodiment of the invention has the same effect as the electronic timepiece 100 described above. In addition, part or all of the crystal 84 side of the antenna 41 is on the crystal 84 side of the solar panel. An aluminum electrode several microns thick is generally disposed to the bottom surface of the solar panel, and reception performance drops as a result. However, by disposing part or all of the crystal 84 side of the antenna 41 above and closer to the crystal 84 than the solar panel 87, reception performance can be maintained.

Embodiment 3

Figure 8:
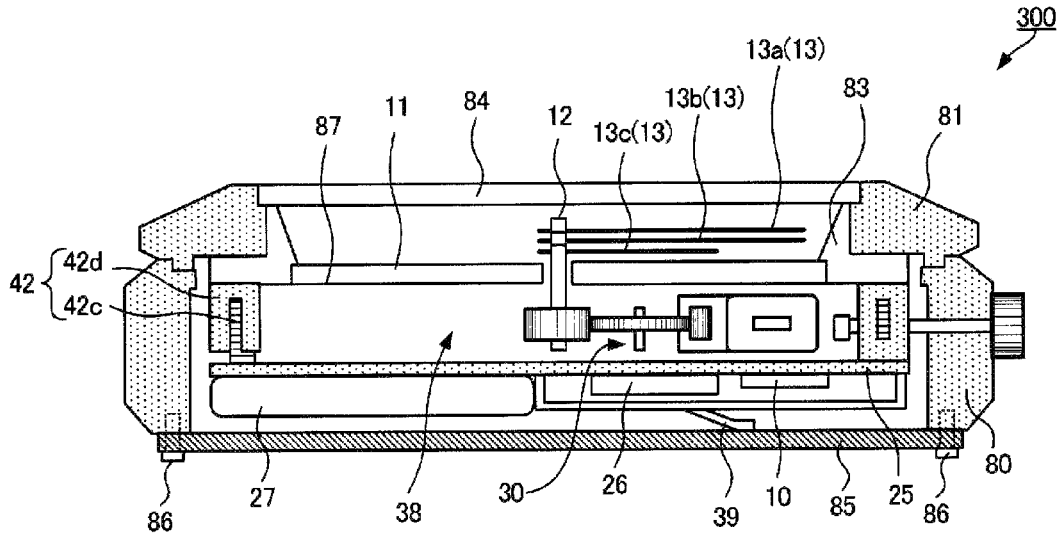
FIG. 8 is a partial section view of an electronic timepiece with internal antenna 300 (electronic timepiece 300) according to a third embodiment of the invention.

FIG. 8 is a partial section view of an electronic timepiece with internal antenna 300 (electronic timepiece 300) according to a third embodiment of the invention.

The electronic timepiece 300 according to this embodiment of the invention uses a different antenna 42 than the antenna 40 of the electronic timepiece 100 described above. This antenna 42 differs from the above antenna 40 in having an annular dielectric base 42*d* with the antenna conductor 42*c* embedded in the dielectric base 42*d*. The antenna conductor 42*c* functions as an antenna element that converts electromagnetic waves to current. This embodiment also does not have a solar panel 87, and the battery 27*a* is a lithium coin battery or other primary battery. The locations of the battery 27 and the GPS reception unit 26 are also reversed from the first embodiment to further separate the GPS reception unit 26 from the sensitive antenna supply nodes.

More specifically, as shown in FIG. 8, a donut-shaped (O-shaped) dielectric base 42*d* extends circumferentially around the drive mechanism 30. The metal antenna conductor 42*c* is embedded in the dielectric base 42*d*, rendering the antenna 42. The shape of the dielectric base 42*d* in section is substantially square. The dielectric base 42*d* is a dielectric such as a dielectric ceramic, but could be formed by insert molding using a plastic mixed with a dielectric. Note that power supply nodes 42*a* and 42*b* are disposed in mutual proximity in the donut-shaped dielectric base 42*d*, and the antenna conductor 42*c* inside the dielectric base 42*d* is a loop with part missing, that is, is C-shaped.

The outside case 80 in this third embodiment of the invention is metal, and the case 80 and the metal back cover 85 function as a ground plate. More specifically, the power supply nodes 42*a* and 42*b* of the antenna 42 are connected through a conductive spring 39 to the metal case 80 or back cover 85. A conductive spring 39 is preferably disposed at plural mutually symmetrical locations when seen in plan view. By providing plural conductive springs 39 at symmetrical locations, circularly polarized satellite signals can be received effectively.

Power is supplied to the other of the power supply nodes 42*a* and 42*b* through an antenna connection terminal not shown. Note that because the antenna 42 is a 1-wavelength loop antenna, it is self-balancing to the power supply, and power can be supplied directly thereto without going through the balun 10.

As will be understood from the foregoing description, the electronic timepiece 300 according to this embodiment of the invention has the same effect as the electronic timepiece 100 described above. In addition, in combination with the wavelength shortening effect of the dielectric base 42*d*, the circumferential length of the antenna can be shortened and the overall size of the antenna can be reduced. By embedding the antenna conductor 42*c* in the dielectric base 42*d*, the metal antenna conductor 42*c* can also be fastened so that it does not move, and device stability can be improved. Because the antenna 42 is substantially square in section, there is no wasted space, space inside the timepiece can be used effectively, and timepiece size can be reduced.

Furthermore, because the case 80 can be made to function as a ground plate by the intervening conductive spring 39 through the power supply nodes 42*a* and 42*b* disposed at mutually proximal positions in the loop antenna, only one antenna connection pin is required, construction is simplified, cost can be reduced, and there is greater freedom determining the location of the power supply node. The balun 10 can also be omitted and size can be further reduced because of the self-balancing effect of the antenna 42 to the power supply.

Other embodiments

Figure 9:
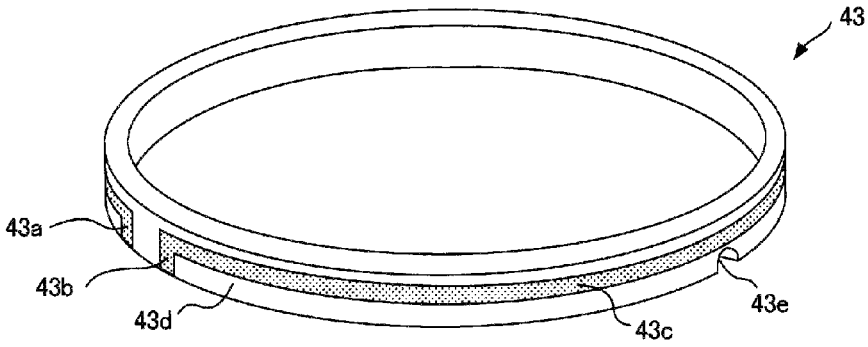
FIG. 9 is an oblique view of the antenna 43 in another embodiment of the invention.
Figure 10:
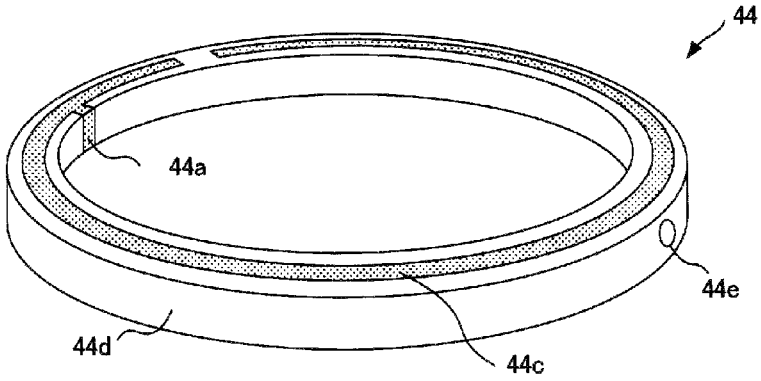
FIG. 10 is an oblique view of the antenna 44 in another embodiment of the invention.
Figure 11:
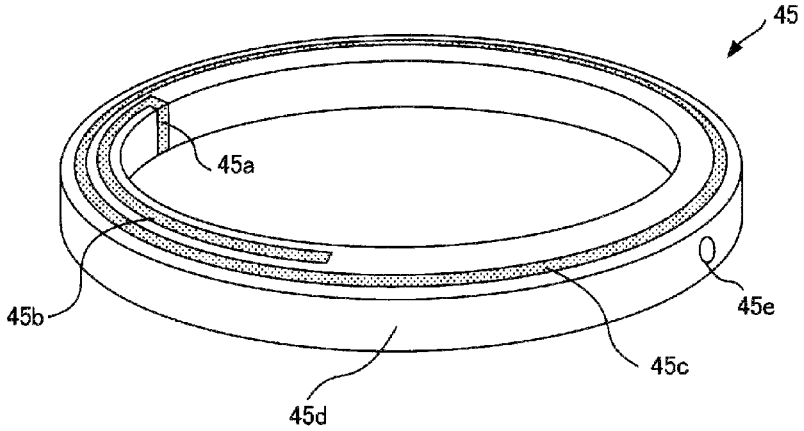
FIG. 11 is an oblique view of the antenna 45 in another embodiment of the invention.

Preferred embodiments of the invention are described above, but the invention is not so limited and can be varied in many ways without departing from the scope of the accompanying claims. Some examples of such variations of the foregoing antennae 40, 41, 42 are described below. FIG. 9 is an oblique view of an antenna 43 according to a first variation of the invention, FIG. 10 is an oblique view of an antenna 44 according to a second variation of the invention, and FIG. 11 is an oblique view of an antenna 45 according to a third variation of the foregoing embodiments.

The antennae 40, 41, 42 described above can be changed to an antenna 43 as shown in FIG. 9. This antenna 43 differs from the foregoing antennae 40, 41, 42 in that the antenna conductor 43*c* is disposed to the outside side surface of the dielectric base 43*d*.

More specifically, the antenna 43 has a donut-shaped (O-shaped) dielectric base 43*d* extending circumferentially. A metal antenna conductor 43*c* is formed by plating or printing silver paste on the outside circumference surface of the dielectric base 43*d*. The antenna conductor 43*c* formed on the outside circumference surface of the dielectric base 43*d* is a loop with part missing, that is, a C-shape. In this embodiment the power supply nodes 43*a* and 43*b* are disposed in mutual proximity on the outside circumference surface of the donut-shaped dielectric base 43*d*. A through-hole 43*e* for inserting an operator to the drive mechanism 30 is disposed in the dielectric base 43*d* at a position interfering with the winding stem. In this embodiment the through-hole 43*e* is a groove disposed to a position not contacting the antenna conductor 43*c* on the outside circumference surface.

Because the antenna conductor 43*c* of this antenna 43 is disposed on the outside circumference surface of a dielectric ring, a thinner dielectric body can be used and wristwatch size can be reduced. Note that to achieve sufficient wavelength shortening, a material with high permittivity must be used to compensate for the smaller volume of the dielectric base 43*d*.

The antennae 40, 41, 42 described above can be changed to an antenna 44 as shown in FIG. 10. This antenna 44 differs from the foregoing antennae 40, 41, 42 in that a specific distance is provided between the power supply node and the gap in the antenna loop.

More specifically, the antenna 44 has a donut-shaped (O-shaped) dielectric base 44*d* extending circumferentially. A metal antenna conductor 44*c* is formed by plating or printing silver paste on the top surface of the dielectric base 44*d*. The antenna conductor 44*c* formed inside the dielectric base 44*d* is a loop with part missing, that is, a C-shape.

In this embodiment a single power supply node 44*a* is disposed at one place on the circumference of the donut-shaped dielectric base 44*d*, and a through-hole 44*e* for inserting an operator to the drive mechanism 30 is disposed at a position interfering with the winding stem.

Circularly polarized waves can be received by the antenna 44 by desirably setting the distance between the power supply node 44*a* and the gap, and GPS signal reception performance can be improved. The antenna conductors 43*c* and 44*c* described above also function as antenna elements that convert electromagnetic waves to current.

The antennae 40, 41, 42 described above can be changed to an antenna 45 as shown in FIG. 11. This antenna 45 differs from the foregoing antennae 40 in that a powered antenna conductor 45*b* and an unpowered antenna conductor 45*c* are used instead of the antenna conductor 40*c* described above.

More specifically, the antenna 45 has a donut-shaped (O-shaped) dielectric base 45*d* extending circumferentially. Metal antenna conductors 45*b* and 45*c* are formed by plating or printing silver paste on the top surface of the dielectric base 45*d*. antenna conductor 45*c* is O-shaped, and antenna conductor 45*b* is formed there inside. The two antenna conductors 45*b* and 45*c* are electromagnetically coupled together. The antenna conductor 45*c* has an antenna length that resonates to radio waves (satellite signals) from positioning information satellites. The two antenna conductors 45*b* and 45*c* function as antenna elements that convert electromagnetic waves to current.

In this embodiment a single power supply node 45*a* is disposed at one place on the circumference of the donut-shaped dielectric base 45*d*, and a through-hole 45*e* for inserting an operator to the drive mechanism 30 is disposed at a position interfering with the winding stem.

By appropriately setting the length of antenna conductor 45*b* in this antenna 45, impedance can be easily matched to the circuit electrically connected to the antenna 45.

The entire disclosure of Japanese Patent Application Nos. 2011-187270, filed Aug. 30, 2011 and 2012-113357, filed May 17, 2012 are expressly incorporated by reference herein.

What is claimed is:

1. An electronic timepiece comprising:

a cylindrical outside case of which at least part is made from a non-conductive material;

a time display unit that displays time inside the outside case;

a drive unit that drives the time display unit inside the outside case;

an antenna that receives signals from positioning information satellites, is disposed around the drive unit inside the outside case, and includes an annular dielectric base and an annular antenna element in contact with the dielectric base;

a crystal covering one of the two openings in the outside case;

a metal back cover covering the other of the two openings on the opposite side of the time display unit as the display side; and a circuit board that is housed inside the outside case and includes a radio communication circuit for radio communication;

wherein the antenna is disposed on the crystal side of the circuit board, and the radio communication circuit is disposed on the back cover side of the circuit board.

2. The electronic timepiece described in claim 1, wherein:

wherein a through-hole is formed on the antenna for inserting an operator of the electronic timepiece from the outside of the antenna to the drive unit.

3. The electronic timepiece described in claim 1, wherein:

the antenna element is disposed in contact with the crystal side of the dielectric base.

4. The electronic timepiece described in claim 1, further comprising:

a solar panel for photovoltaic generation;

wherein part or all of the crystal side of the antenna is disposed closer to the crystal than is the solar panel.

* * * * *